US011098547B2

(12) United States Patent
Amoudi et al.

(10) Patent No.: US 11,098,547 B2
(45) Date of Patent: Aug. 24, 2021

(54) FREEING STUCK TUBULARS IN WELLBORES

(71) Applicant: Saudi Arabian Oil Company, Dhahran (SA)

(72) Inventors: Ahmad A. Amoudi, Dhahran (SA); Ossama R. Sehsah, Dhahran (SA); Abdulrahman K. Aleid, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/558,927

(22) Filed: Sep. 3, 2019

(65) Prior Publication Data

US 2021/0062633 A1 Mar. 4, 2021

(51) Int. Cl.

| | |
|---|---|
| ***E21B 31/00*** | (2006.01) |
| ***E21B 44/00*** | (2006.01) |
| ***E21B 31/107*** | (2006.01) |
| ***E21B 7/06*** | (2006.01) |
| ***E21B 31/113*** | (2006.01) |

(52) U.S. Cl.

CPC ..... *E21B 31/00* (2013.01); *E21B 7/06* (2013.01); *E21B 7/062* (2013.01); *E21B 31/005* (2013.01); *E21B 31/107* (2013.01); *E21B 31/113* (2013.01); *E21B 44/005* (2013.01)

(58) Field of Classification Search

CPC ..... E21B 7/06; E21B 7/062; E21B 31/107; E21B 31/113; E21B 31/005

See application file for complete search history.

(56) References Cited

U.S. PATENT DOCUMENTS

| | | | | |
|---|---|---|---|---|
| 4,593,560 | A | 6/1986 | Purfurst | |
| 5,987,385 | A | 11/1999 | Varsamis et al. | |
| 7,013,992 | B2 | 3/2006 | Tessari et al. | |
| 10,113,408 | B2 | 10/2018 | Pobedinski et al. | |
| 2008/0308279 | A1 | 12/2008 | Zazovsky et al. | |
| 2011/0088903 | A1 | 4/2011 | Onadeko et al. | |
| 2018/0171774 | A1 | 6/2018 | Ringer et al. | |
| 2018/0230767 | A1 | 8/2018 | Sehsah et al. | |
| 2019/0301244 | A1* | 10/2019 | Moore | E21B 44/00 |
| 2019/0368295 | A1* | 12/2019 | Machocki | E21B 31/107 |

OTHER PUBLICATIONS

PCT International Search Report and Written Opinion in International Appln. No. PCT/US2020/049046, dated Dec. 1, 2020, 14 pages.

* cited by examiner

*Primary Examiner* — Tara Schimpf

(74) *Attorney, Agent, or Firm* — Fish & Richardson P.C.

(57) ABSTRACT

An apparatus includes a tubular, pressure sensors, expandable pads, a hydraulic chamber, and a computer system. The apparatus can be run in a wellbore. The apparatus is configured to detect whether the tubular is stuck within the wellbore. In response to determining that the tubular is stuck within the wellbore, the apparatus can determine a local of sticking of the tubular in the wellbore and can transmit a signal to the hydraulic chamber to pressurize one or more of the expandable pads, thereby causing the one or more expandable pads to expand and exert a force necessary to free the tubular.

14 Claims, 8 Drawing Sheets

FREEING STUCK TUBULARS IN WELLBORES

TECHNICAL FIELD

This disclosure relates to wellbores and tubulars lowered into wellbores.

BACKGROUND

Differential sticking is a type of tubular sticking that can be caused by the pressure difference between the wellbore and a permeable zone. When differential sticking occurs, a portion of the tubular becomes embedded in a mudcake that forms, for example, during drilling. Sticking of tubulars in a wellbore can be a major cost issue in drilling operations. When a drillstring experiences differential sticking, the drillstring cannot be moved (rotated or reciprocated) along the axis of the wellbore. Because of this, differential sticking can be problematic, as it extends drilling time and incurs financial cost.

SUMMARY

This disclosure describes technologies relating to freeing stuck tubulars in wellbores. In a first general aspect, an apparatus includes a tubular, three pressure sensors, three expandable pads, a hydraulic chamber, and a computer system. The pressure sensors are distributed along an outer circumference of the tubular. The expandable pads are distributed along the outer circumference of the tubular. The hydraulic chamber is disposed within the tubular. The hydraulic chamber is configured to expand each of the expandable pads independently. The computer system is disposed within the tubular. The computer system includes a processor and a storage medium. The storage medium is interoperably coupled to the processor and stores programming instructions for execution by the processor. The programming instructions instruct the processor to perform operations including, in response to determining that the tubular is stuck within the wellbore, determining a locale of sticking of the tubular based on the pressure readings transmitted by the pressure sensors and transmitting a pressure signal to cause the hydraulic chamber to pressurize one or more of the expandable pads, thereby causing the one or more expandable pads to expand and exert a force necessary to free the tubular.

In a second general aspect, pressure is detected by three pressure sensors at three locations corresponding to a distribution of the three pressure sensors along an outer circumference of a tubular disposed within a wellbore. By a computer system disposed within the tubular, it is determined that the tubular is stuck within the wellbore based on the detected pressure. In response to determining that the tubular is stuck within the wellbore, a locale of sticking of the tubular is determined based on the detected pressures; a force necessary to free the tubular is determined based on the detected pressures; a pressure necessary in a hydraulic chamber to exert the force necessary to free the tubular is determined; and a pressure signal is transmitted to cause the hydraulic chamber to pressurize one or more expandable pads, thereby causing the one or more expandable pads to expand and exert the force to free the tubular.

In a third general aspect, multiple pressure readings are received from multiple pressure sensors distributed along an outer circumference of a tubular disposed within a wellbore. It is determined that the tubular is stuck within the wellbore based on the pressure readings. In response to determining that the tubular is stuck in the wellbore, a locale of sticking of the tubular is determined based on the pressure readings, and a signal is transmitted to cause a force to be exerted to free the tubular.

Implementations of the first, second, and third general aspects may include one or more of the following features.

The programming instructions can instruct the processor to perform operations including determining that the tubular is stuck within the wellbore based on the pressure readings transmitted by the pressure sensors.

The programming instructions can instruct the processor to perform operations including: determining the force necessary to free the tubular based on the pressure readings transmitted by the pressure sensors; and determining a corresponding pressure necessary in the hydraulic chamber to expand the one or more expandable pads and exert the force to free the tubular.

The apparatus can include three circulating ports distributed along the outer circumference of the tubular. The programming instructions can instruct the processor to perform operations including transmitting a circulation signal to cause one or more of the circulating ports to open and allow circulation of drilling fluid out of the tubular.

The expandable pads can be positioned on the tubular between the circulating ports and the pressure sensors.

A distribution of the expandable pads along the outer circumference of the tubular can be the same as a distribution of the pressure sensors along the outer circumference of the tubular.

The signal transmitted to the hydraulic chamber can cause the hydraulic chamber to pressurize one or more expandable pads distributed along the outer circumference of the tubular, thereby causing the one or more expandable pads to expand and exert the force to free the tubular.

The circulation signal can be transmitted after the signal that causes the force to be exerted to free the tubular.

The details of one or more implementations of the subject matter of this disclosure are set forth in the accompanying drawings and the description. Other features, aspects, and advantages of the subject matter will become apparent from the description, the drawings, and the claims.

DETAILED DESCRIPTION

This disclosure generally relates to automatic centralization of a tubular (for example, a drill string) within a wellbore where differential sticking may occur, for example, during drilling or workover operations. One or more pressure sensors detect various characteristics, such as sticking interval, location of sticking, and intensity of sticking. Based on such characteristics, a computer system determines the required force to free the string and the corresponding pressure to provide the required force. The pressure is provided hydraulically to expand one or more expandable pads to free the tubular. The subject matter described in this disclosure can be implemented in particular implementations, so as to realize one or more of the following advantages. Sticking of the tubular can be automatically (that is, without user intervention) detected, and the location of sticking can be automatically identified. In response to detecting that the tubular is stuck, the force necessary to free the tubular can be automatically calculated. One or more components of the apparatus (that identifies differential sticking of a tubular and subsequently frees the tubular) can be tagged and identified, for example, by radio frequency identification (RFID), so that each of the tagged components can be actuated independently. Once the tubular has been freed, drilling fluid can be automatically circulated around the previous stuck area of the tubular in order to prevent future sticking.

Figure 1A:
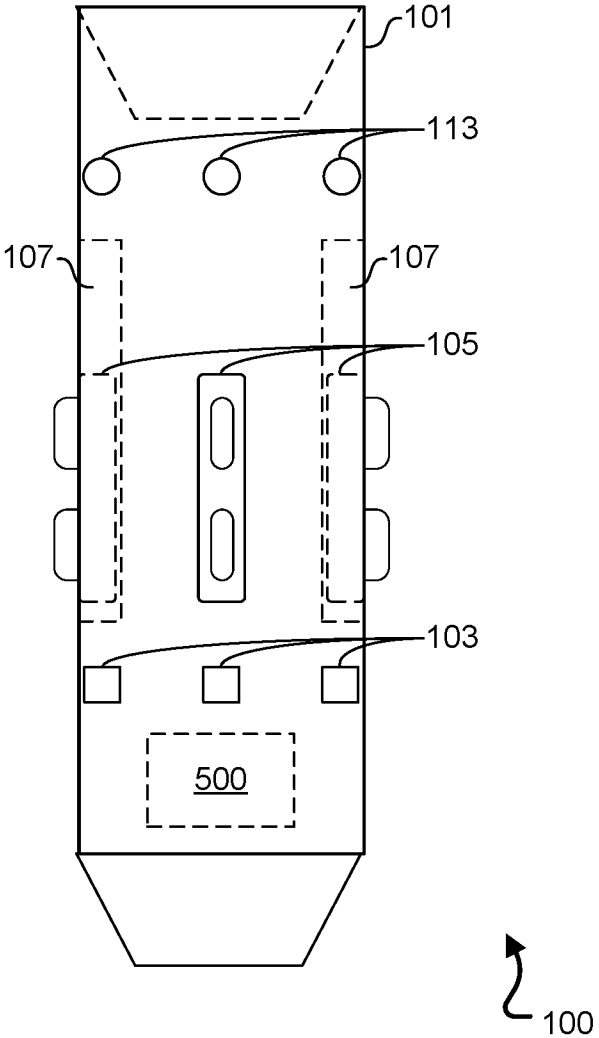
FIG. 1A is a schematic diagram of an apparatus that can be used to detect sticking of a tubular and subsequently free the tubular.

FIG. 1A is a schematic diagram of an apparatus 100 that can be used to detect sticking of a tubular and subsequently free the tubular. The apparatus 100 includes a tubular 101, at least three pressure sensors 103, at least three expandable pads 105, a hydraulic chamber 107, and a computer system 500. The apparatus 100 can be connected to other components, such as additional tubular components on each end of the apparatus 100. For example, the apparatus 100 can be a part of a drill string. Each of the pressure sensors 103 can detect a pressure at the location at which the respective pressure sensor 103 is located on the tubular 101. Each of the pressure sensors 103 is coupled to the computer system 500 and can transmit a pressure reading representing the detected pressure to the computer system 500.

The expandable pads 105 can include, for example, telescopic blades. The telescopic blade can emerge and retract from an outer circumferential surface of the tubular 101. The blades are not necessarily sharp. The blades can be smooth and can have a generally half-ellipsoidal or cylindrical shape. In such cases, the smooth blades can facilitate retrieval of the tubular by reducing drag as one or more of the blades remain in contact with a wall of the well.

The pressure sensors 103 and the expandable pads 113 are distributed along an outer circumference of the tubular 101. In some implementations, the distribution of the expandable pads 105 along the outer circumference of the tubular 101 is the same as the distribution of the pressure sensors 103 along the outer circumference of the tubular 101. That is, each of the expandable pads 105 is longitudinally aligned with a different one of the pressure sensors 103 with respect to the tubular 101. Although shown in FIG. 1A as having three pressure sensors 103, the apparatus 100 can include additional pressure sensors, for example, four, five, or more than five pressure sensors. Similarly, the apparatus 100 can include additional expandable pads, for example, four, five, or more than five expandable pads. In some implementations, the apparatus 100 includes the same number of pressure sensors 103 and expandable pads 105, but this is not necessary.

Figure 1B:
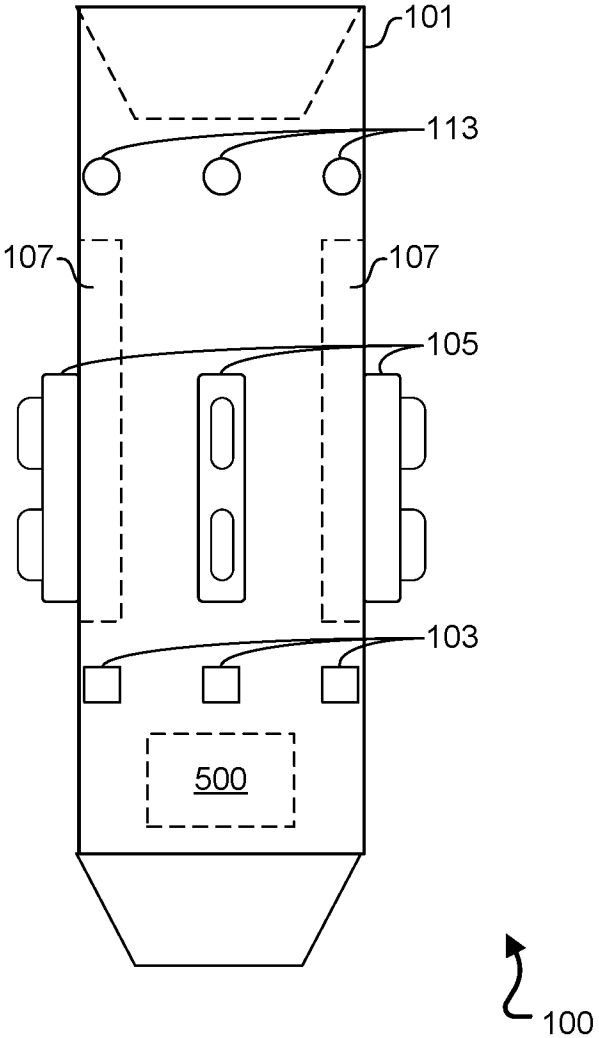
FIG. 1B shows the apparatus of FIG. 1A with expanded pads.

The hydraulic chamber 107 is disposed within the tubular 101. The hydraulic chamber 107 can include an enclosure that contains liquid. The inner volume of the enclosure of the hydraulic chamber 107 can be decreased, thereby causing an increase in pressure of the enclosed liquid which can in turn expand one or more of the expandable pads 105. For example, a hydraulic power unit can pressurize the liquid within the hydraulic chamber 107 by moving a piston to decrease the inner volume of the enclosure of the hydraulic chamber 107. The hydraulic chamber 107 is configured to expand each of the expandable pads 105 independently of each other. The hydraulic chamber 107 can expand, for example, only one of the expandable pads 105 (without expanding the others) or multiple expandable pads 105 at the same time. Expanding an expandable pad 105 can cause the respective telescopic blade to emerge from the tubular 101. FIG. 1B shows the apparatus of FIG. 1A with two of the expandable pads 105 expanded. As shown in FIG. 1B, when expanded, the expandable pad 105 extends past the outer circumference of the tubular 101.

Still referring to FIGS. 1A and 1B, the apparatus 100 can include one or more circulating ports distributed along the outer circumference of the tubular 101. Although shown in FIGS. 1A and 1B as having three circulating ports 113, the apparatus 100 can include fewer or additional circulating ports, for example, one, two, or more than three circulating ports. In some implementations, the distribution of the circulating ports 113 along the outer circumference of the tubular 101 is the same as the distribution of the expandable pads 105 along the outer circumference of the tubular 101. In some implementations, the apparatus 100 includes the same number of circulating ports 113 and expandable pads 105, but this is not necessary. As shown in FIGS. 1A and 1B, the expandable pads 105 can be positioned on the tubular 101 between the circulating ports 113 and the pressure sensors 103. In other implementations, the circulating ports 113 can be positioned on the tubular 101 between the pressure sensors 103 and the expandable pads 105.

The computer system 500 can be configured to determine whether the tubular 101 is stuck within the wellbore, for example, based on pressure readings transmitted by the pressure sensors 103. For example, during normal operation (where the tubular 101 is not stuck), it is expected that the pressure sensors 103 detect a pressure that is substantially equal to the hydrostatic pressure of the drilling fluid at true vertical depth. If the tubular 101 is stuck (for example, on one side of the tubular 101), the pressure sensor 103 closest to the locale of sticking will detect a pressure less than the hydrostatic pressure of the drilling fluid at true vertical depth. In some cases, this pressure sensor 103 will detect a pressure that is substantially equal to or similar to a formation pressure. Therefore, this decrease in detected pressure can signify that the tubular 101 is stuck in at least that portion of the tubular 101.

In response to determining that the tubular 101 is stuck within the wellbore, the computer system 500 can be configured to determine a locale of sticking of the tubular 101 based on the pressure readings transmitted by the pressure sensors 103. In response to determining that the tubular 101 is stuck within the wellbore at the locale of sticking, the computer system 500 can be configured to transmit a signal to cause the hydraulic chamber 107 to pressurize one or more of the expandable pads 105 in order to cause the one or more expandable pads 105 to expand and exert a force to free the tubular 101. For example, the computer system 500 can transmit a pressure signal to cause the hydraulic chamber 107 to expand one or two of the expandable pads 105 that are located closest to the locale of sticking of the tubular 101 determined by the computer system 500 based on the pressure readings transmitted by the pressure sensors 103. The force exerted by the expanded expandable pads 105 can counteract the sticking force of the tubular 101 stuck in the wellbore. In some implementations, the computer system 500 is configured to transmit a signal to cause one or more of the circulating ports 113 to open and allow circulation of drilling fluid out of the tubular 101. Allowing the circulation of drilling fluid can prevent sticking of the tubular 101.

Once the pressure sensors 103 detect expected pressure values (for example, substantially equal to the hydrostatic pressure of the drilling fluid at true vertical depth), the tubular 101 has been freed (unstuck). The computer system 500 can be configured to transmit a signal to cause the one or more expanded expandable pads 105 to retract and return to their original state (that is, not expanded) after the tubular 101 is freed. The computer system 500 can also be configured to transmit a signal to cause one or more of the circulating ports 113 to close and cease circulation of drilling fluid out of the tubular 101 after the tubular 101 is freed.

In some cases, the tubular 101 can become stuck for a short period of time and become free without the need for intervention or activation of any components of the apparatus 100. Because of this, in some implementations, the apparatus 100 can be configured to implement an unsticking process after one or more of the pressure sensors 103 have detected a pressure that is less than expected for at least a time duration threshold. For example, if one or more of the pressure sensors 103 detects a pressure that is less than expected (for example, less than the hydrostatic pressure of the drilling fluid at true vertical depth) for at least 10 seconds, it can be determined that the tubular 101 is stuck, and the unsticking process should be implemented.

In some implementations, the computer system 500 is configured to determine the force necessary to free the tubular 101 based on the pressure readings transmitted by the pressure sensors 103. In some implementations, the computer system 500 is configured to determine a corresponding pressure that is necessary in the hydraulic chamber 107 to expand the one or more expandable pads 105 and exert the force to free the tubular 101. For example, the computer system 500 can be configured to calculate an expected pressure equal to the expected hydrostatic pressure of the drilling fluid based on true vertical depth. As another example, the computer system 500 can be configured to calculate an expected pressure equal to the average of the pressures detected by the pressure sensors 103. If any of the pressures detected by the pressure sensors 103 deviate from the average (for example, by more than 10%), then the tubular 101 can be determined to be stuck. The corresponding pressure necessary to unstick the tubular 101 can be based on the difference between the expected pressure and the actual detected pressure.

Figure 2A:
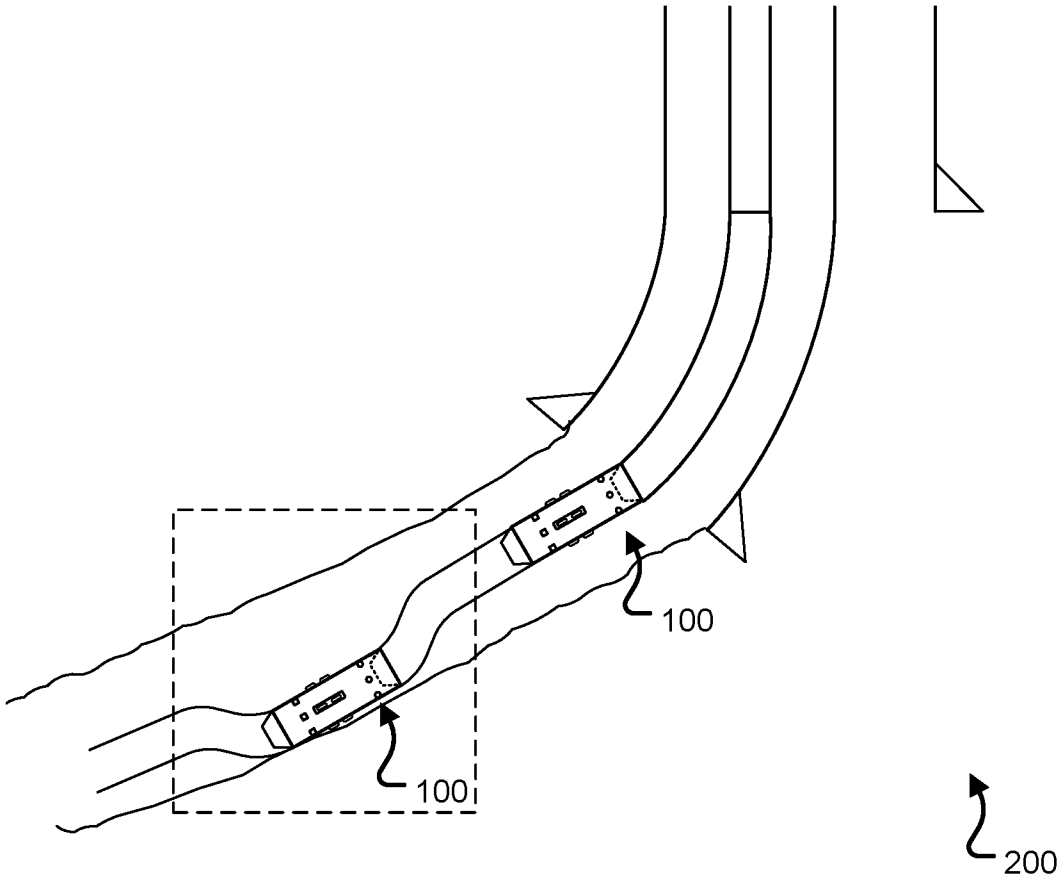
FIG. 2A is a schematic diagram of the apparatus of FIG. 1A disposed in an example well.

FIG. 2A depicts an example well 200 constructed in accordance with the concepts described here. The well 200 extends from the surface through the Earth to one more subterranean zones of interest. The well 200 enables access to the subterranean zones of interest to allow recovery (that is, production) of fluids to the surface and, in some implementations, additionally or alternatively allows fluids to be placed in the Earth. In some implementations, the subterranean zone is a formation within the Earth defining a reservoir, but in other instances, the zone can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured in any significant amount. The well 200 can be a vertical well or a deviated well with a wellbore deviated from vertical (for example, horizontal or slanted) and/or the well 200 can include multiple bores, forming a multilateral well (that is, a well having multiple lateral wells branching off another well or wells).

In some implementations, the well 200 is a gas well that is used in producing natural gas from the subterranean zones of interest to the surface. While termed a "gas well", the well need not produce only dry gas, and may incidentally or in much smaller quantities, produce liquid including oil and/or water. In some implementations, the well 200 is an oil well that is used in producing crude oil from the subterranean zones of interest to the surface. While termed an "oil well", the well not need produce only crude oil, and may incidentally or in much smaller quantities, produce gas and/or water. In some implementations, the production from the well 200 can be multiphase in any ratio, and/or can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources, and/or could be used in injection wells, disposal wells, or other types of wells used in placing fluids into the Earth.

The wellbore of the well 200 is typically, although not necessarily, cylindrical. All or a portion of the wellbore is lined with a tubing, such as casing. The casing connects with a wellhead at the surface and extends downhole into the wellbore. The casing operates to isolate the bore of the well 200, defined in the cased portion of the well 200 by the inner bore of the casing from the surrounding Earth. The casing can be formed of a single continuous tubing or multiple lengths of tubing joined (for example, threadedly and/or otherwise) end-to-end. The casing can be perforated in the subterranean zone of interest to allow fluid communication between the subterranean zone of interest and the bore of the casing. In some implementations, the casing is omitted or ceases in the region of the subterranean zone of interest. This portion of the well 200 without casing is often referred to as "open hole."

The wellhead defines an attachment point for other equipment to be attached to the well 200. For example, well 200 can be produced with a Christmas tree attached the wellhead. The Christmas tree includes valves used to regulate flow into or out of the well 200. The well 200 can include a production system residing in the wellbore, for example, at a depth that is nearer to subterranean zone than the surface. The production system, being of a type configured in size and robust construction for installation within a well 200, can include any type of rotating equipment that can assist production of fluids to the surface and out of the well 200 by creating an additional pressure differential within the well 200. For example, the production system can include a pump, compressor, blower, or multi-phase fluid flow aid.

In particular, casing is commercially produced in a number of common sizes specified by the American Petroleum Institute (the "API), including 4½, 5, 5½, 6, 6⅝, 7, 7⅝, 16/8, 9⅝, 10¾, 11¾, 13⅜, 16, 116/8 and 20 inches, and the API specifies internal diameters for each casing size. The production system can be configured to fit in, and (as discussed in more detail below) in certain instances, seal to the inner diameter of one of the specified API casing sizes. Of course, the production system can be made to fit in and, in certain instances, seal to other sizes of casing or tubing or otherwise seal to a wall of the well 200.

Additionally, the construction of the components of the production system are configured to withstand the impacts, scraping, and other physical challenges the production system will encounter while being passed hundreds of feet/meters or even multiple miles/kilometers into and out of the well 200. For example, the production system can be disposed in the well 200 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the production system is configured to withstand and operate for extended periods of time (e.g., multiple weeks, months or years) at the pressures and temperatures experienced in the well 200, which temperatures can exceed 400° F./205° C. and pressures over 2,000 pounds per square inch, and while submerged in the well fluids (gas, water, or oil as examples). Finally, the production system can be configured to interface with one or more of the common deployment systems, such as jointed tubing (that is, lengths of tubing joined end-to-end, threadedly and/or otherwise), a sucker rod, coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

A seal system integrated or provided separately with the production system can divide the well 200 into an uphole zone above the seal system and a downhole zone below the seal system. The wall of the well 200 includes the interior wall of the casing in portions of the wellbore having the casing and the open hole wellbore wall in uncased portions of the well 200. Thus, the seal system can be configured to seal against the wall of the wellbore, for example, against the interior wall of the casing in the cased portions of the well 200 or against the interior wall of the wellbore in the uncased, open hole portions of the well 200. In certain instances, the seal system can form a gas- and liquid-tight seal at the pressure differential the production system 200 creates in the well 200. For example, the seal system can be configured to at least partially seal against an interior wall of the wellbore to separate (completely or substantially) a pressure in the well 200 downhole of the seal system from a pressure in the well 200 uphole of the seal system. Although not shown, additional components, such as a surface compressor, can be used in conjunction with the production system to boost pressure in the well 200.

In some implementations, the production system 200 can be implemented to alter characteristics of a wellbore by a mechanical intervention at the source. Alternatively, or in addition to any of the other implementations described in this specification, the production system 200 can be implemented as a high flow, low pressure rotary device for gas flow in sub-atmospheric wells. Alternatively, or in addition to any of the other implementations described in this specification, the production system 200 can be implemented in a direct well-casing deployment for production through the wellbore. Other implementations of the production system 200, such as a pump, compressor, or multi-phase combination of these, can be utilized in the wellbore to effect increased well production.

The production system can locally alter the pressure, temperature, and/or flow rate conditions of the fluid in the well 200 proximate the production system. In certain instances, the alteration performed by the production system can optimize or help in optimizing fluid flow through the well 200. As described previously, the production system can create a pressure differential within the well 200, for example, particularly within the locale in which the production system resides. In some instances, a pressure at the base of the well 200 is a low pressure (for example, sub-atmospheric); so unassisted fluid flow in the wellbore can be slow or stagnant. In these and other instances, the production system introduced to the well 200 adjacent the perforations can reduce the pressure in the well 200 near the perforations to induce greater fluid flow from the subterranean zone, increase a temperature of the fluid entering the production system to reduce condensation from limiting production, and/or increase a pressure in the well 200 uphole of the production system to increase fluid flow to the surface.

The production system can move fluid at a first pressure downhole of the production system to a second, higher pressure uphole of the production system. The production system can operate at and maintain a pressure ratio across the production system between the second, higher uphole pressure and the first, downhole pressure in the wellbore. The pressure ratio of the second pressure to the first pressure can also vary, for example, based on an operating speed of the production system.

The production system can operate in a variety of downhole conditions of the well 200. For example, the initial pressure within the well 200 can vary based on the type of well, depth of the well 200, production flow from the perforations into the well 200, and/or other factors. In some examples, the pressure in the well 200 proximate a bottomhole location is sub-atmospheric, where the pressure in the well 200 is at or below about 14.7 pounds per square inch absolute (psia), or about 101.3 kiloPascal (kPa). The production system can operate in sub-atmospheric well pressures, for example, at well pressure between 2 psia (13.8 kPa) and 14.7 psia (101.3 kPa). In some examples, the pressure in the well 200 proximate a bottomhole location is much higher than atmospheric, where the pressure in the well 200 is above about 14.7 pounds per square inch absolute (psia), or about 101.3 kiloPascal (kPa). The production system can operate in above atmospheric well pressures, for example, at well pressure between 14.7 psia (101.3 kPa) and 5,000 psia (34,474 kPa).

Figure 2B:
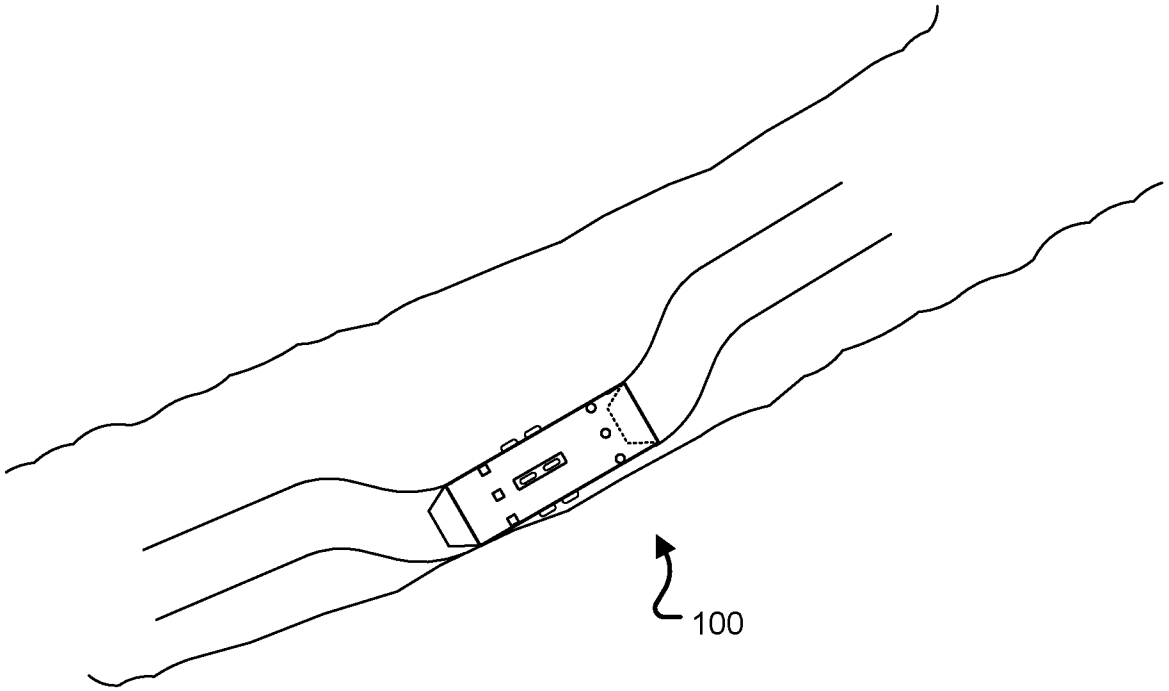
FIG. 2B is an enlarged view of the diagram of FIG. 2A.

As shown in FIG. 2A, the well 200 can include one or more of the apparatus 100. FIG. 2A illustrates an instance in which the apparatus 100 located further downhole is not centralized within the wellbore and has become stuck. FIG. 2B is an enlarged view of the diagram of FIG. 2A.

Figure 2C:
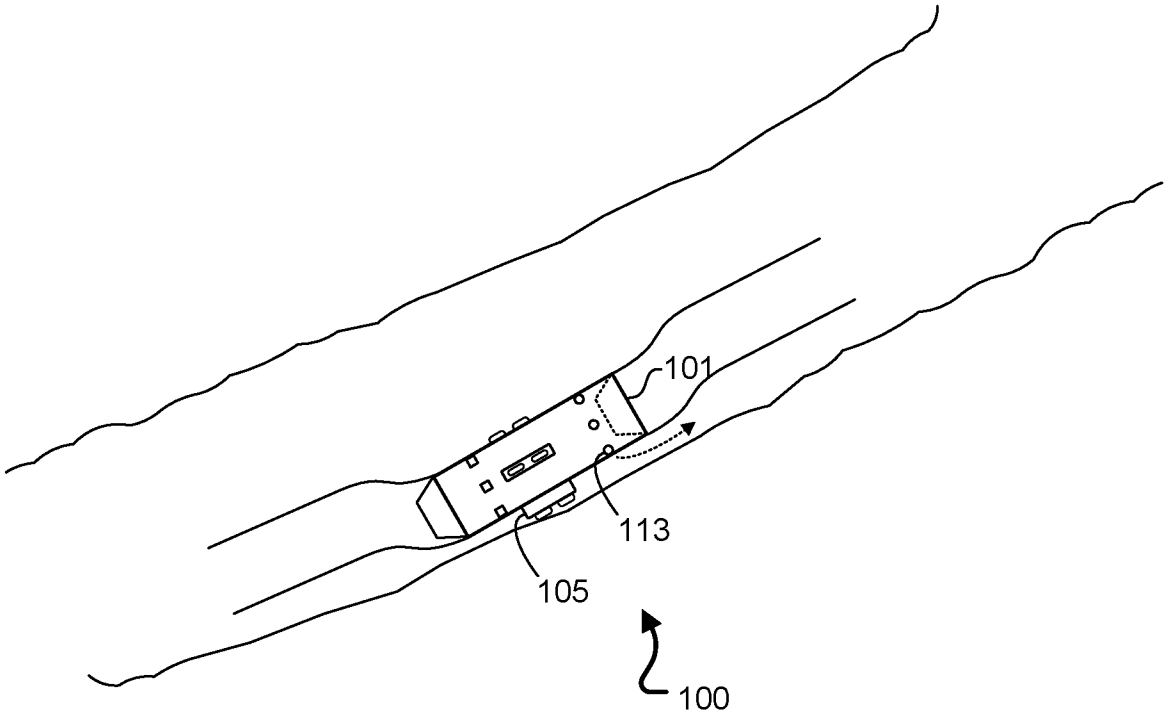
FIG. 2C is a schematic diagram of the apparatus of FIG. 1A being used to free a tubular from the well.

FIG. 2C is a schematic diagram of the apparatus of FIG. 1A being used to free the tubular from the well. As shown in FIG. 2C, one of the expandable pads 105 has been expanded. The expansion of the expandable pad 105 exerts a force against the wall of the wellbore to free the tubular 101. In this instance, after the tubular 101 has been freed, one of the circulating ports 113 opens, so that drilling fluid can be circulated around the location where the tubular 101 was previously stuck. An example flow of drilling fluid is depicted by the dotted arrow in FIG. 2C. This flow of drilling fluid can prevent future sticking of the tubular 101 in the wellbore.

Figure 3:
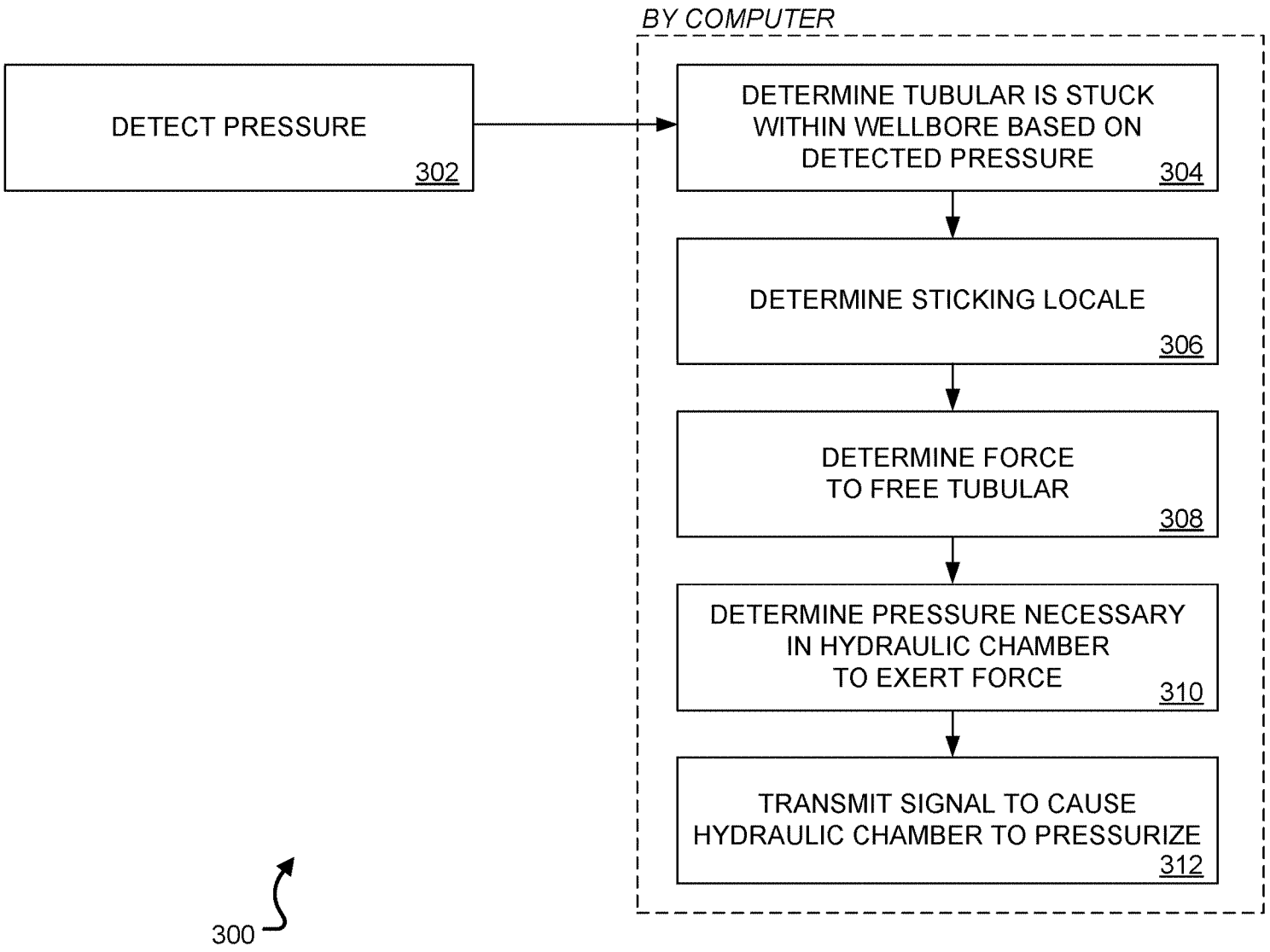
FIG. 3 is a flow chart of an example method for freeing a tubular stuck in a well.

FIG. 3 is a flow chart of an example method 300 for freeing a tubular (for example, the tubular 101) stuck in a well (for example, the well 200). The method 300 can be implemented using the apparatus 100. At step 302, pressure is detected by at least three pressure sensors (for example, the pressure sensors 103) at different locations corresponding to a distribution of the at least three pressure sensors 103 along an outer circumference of the tubular 101 disposed within a wellbore (for example, the wellbore of the well 200). Steps 304, 306, 308, 310, and 312 can be implemented by a computer (for example, the computer system 500) disposed within the tubular 101.

At step 304, it is determined that the tubular 101 is stuck within the wellbore based on the pressures detected at step 302. The tubular 101 can be determined to be stuck at step 304, for example, based on detecting a pressure less than the hydrostatic pressure of the drilling fluid at true vertical depth. In some implementations, the tubular 101 can be determined to be stuck at step 304 based on detecting a pressure that deviates (for example, by more than 10%) from the average of all the detected pressures from the pressure sensors 103.

In response to determining that the tubular 101 is stuck within the wellbore at step 304, the method 300 proceeds to steps 306, 308, 310, and 312. At step 306, a locale of sticking of the tubular 101 is determined based on the detected pressures from step 302. For example, if one of the pressure sensors 103 detects a pressure that is different from the expected pressure (such as the hydrostatic pressure of the drilling fluid at true vertical depth), then it can be determined that the tubular 101 is stuck in the locale in which that particular pressure sensor 103 is located in relation to the tubular 101.

At step 308, a force necessary to free the tubular is determined based on the detected pressures from step 302. For example, the computer system 500 can calculate the necessary force to counteract the sticking force of the tubular 101 stuck in the wellbore. The force can be calculated, for example, by determining the pressure difference between the detected pressure and the expected pressure. When the tubular 101 is stuck, the detected pressure is less than the expected pressure. In some cases, the detected pressure is substantially equal to the formation pressure, and the expected pressure is substantially equal to the hydrostatic pressure of the drilling fluid at true vertical depth (bottomhole pressure). In such cases, the pressure difference is substantially equal to the difference between the formation pressure and the bottomhole pressure. For example, for a bottomhole pressure of 32,500 pounds per square inch gauge (psig) and a formation pressure of 3,200 psig, the pressure difference is equal to 300 pounds per square inch differential (psid). The force can then be calculated to be the pressure difference multiplied by the stuck area of the tubular 101. For example, for a stuck area of 3 square inches, the necessary force is equal to 900 pounds.

At step 310, a pressure necessary in a hydraulic chamber (for example, the hydraulic chamber 107) to exert the force necessary to free the tubular 101 determined at step 308. The pressure necessary in the hydraulic chamber 107 is affected by the size of the expandable pads 105. For example, the pressure in the hydraulic chamber 107 should be at least equal to the necessary force calculated at step 308 divided by the area of the one or more expandable pads 105 that will be expanded in order to free the tubular 101.

At step 312, a signal is transmitted to the hydraulic chamber 107 to cause the hydraulic chamber 107 to pressurize one or more expandable pads (for example, one or more of the expandable pads 105) to expand and exert the force to free the tubular 101. Each of the expandable pads 105 can have an associated RFID, such that the computer system 500 can send the signal to the one or more expandable pads 105 that are, for example, closest to the locale of sticking of the tubular 101. In some implementations, the method 300 includes transmitting, by the computer system 500, a circulation signal to one or more circulating ports (for example, one or more of the circulating ports 113) to cause the one or more circulating ports 113 to open and allow circulation of drilling fluid out of the tubular 101.

Figure 4:
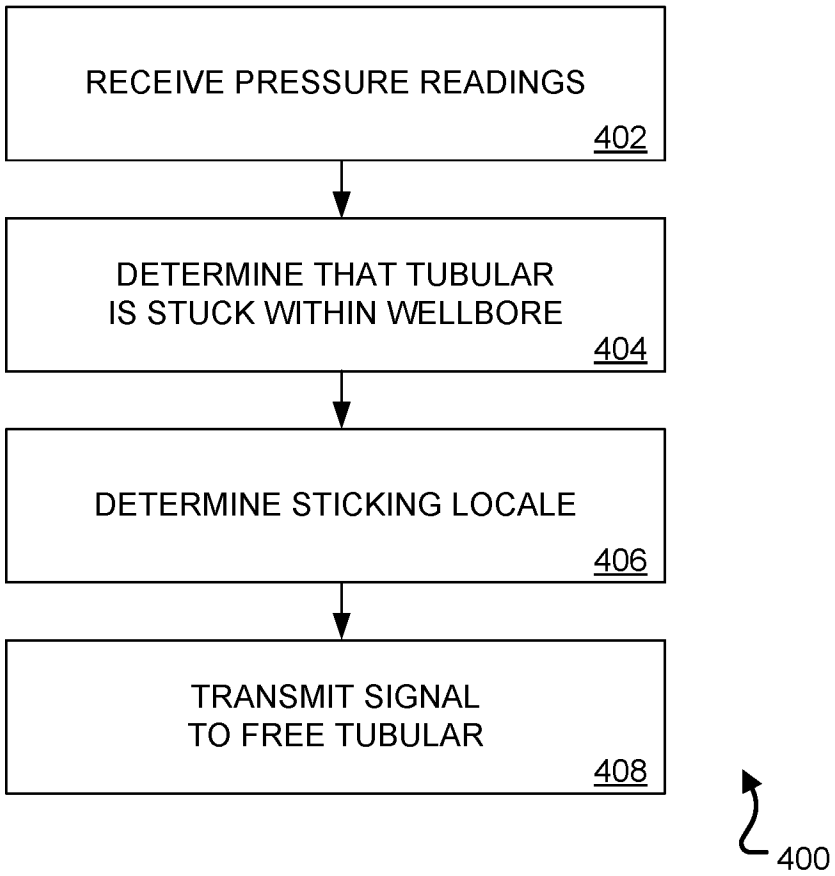
FIG. 4 is a flow chart of an example computer-implemented method for freeing a tubular stuck in a well.

FIG. 4 is a flow chart of an example computer-implemented method 400 for freeing a tubular (for example, the tubular 101) stuck in a well (for example, the well 200). The method 400 can be implemented by the computer system 500 of the apparatus 100. The method 400 can, for example, be automatically implemented by the computer system 500 of the apparatus 100 without requiring user intervention in between steps. At step 402, a plurality of pressure readings are received from a corresponding plurality of pressure sensors (for example, the pressure sensors 103) distributed along an outer circumference of the tubular 101 disposed within a wellbore (for example, the wellbore of the well 200).

At step 404, it is determined that the tubular 101 is stuck within the wellbore based on the plurality of pressure readings received at step 402. The tubular 101 can be determined to be stuck at step 404, for example, based on detecting a pressure less than the hydrostatic pressure of the drilling fluid at true vertical depth. In some implementations, the tubular 101 can be determined to be stuck at step 304 based on detecting a pressure that deviates (for example, by more than 10%) from the average of all the detected pressures from the pressure sensors 103.

In response to determining that the tubular 101 is stuck within the wellbore at step 404, the method 400 proceeds to step 406 at which a locale of sticking of the tubular 101 is determined based on the plurality of pressure readings received at step 402.

The method 400 proceeds to step 408 at which a signal is transmitted to cause a force to be exerted to free the tubular 101. In some implementations, the method 400 includes determining the force necessary to free the tubular 101 based on the plurality of pressure readings received at step 402 (similar to step 308 of method 300). In some implementations, the method 400 includes determining a corresponding pressure necessary in a hydraulic chamber (for example, the hydraulic chamber 107) disposed within the tubular 101 to exert the force to free the tubular 101 (similar to step 310 of method 300). In some implementations, the signal transmitted at step 408 causes the hydraulic chamber 107 to pressurize one or more expandable pads (for example, one or more of the expandable pads 105) distributed along the outer circumference of the tubular 101, thereby causing the tone or more expandable pads 105 to expand and exert the force to free the tubular 101 (similar to step 312 of method 300).

In some implementations, the method 400 includes transmitting a circulation signal to one or more circulating ports (for example, one or more of the circulating ports 113) distributed along the outer circumference of the tubular 101 to cause the one or more circulating ports 113 to open and allow circulation of drilling fluid out of the tubular 101. In some implementations, the circulation signal is transmitted after the signal transmitted at step 408.

Figure 5:
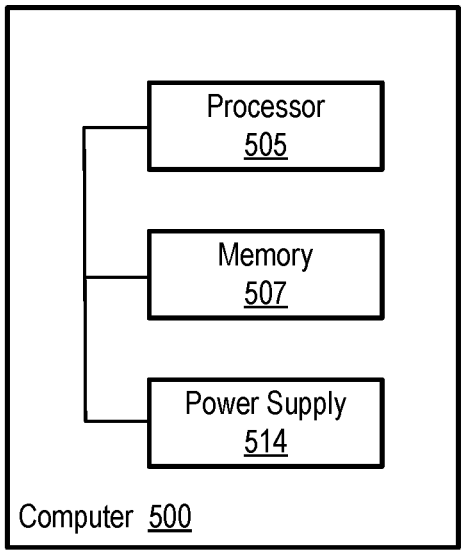
FIG. 5 is a block diagram of an example computer system that can be included in the apparatus of FIG. 1A.

FIG. 5 is a block diagram of an example computer system 500 used to provide computational functionalities associated with described algorithms, methods, functions, processes, flows, and procedures, as described in this specification, according to an implementation. The illustrated computer system 500 is intended to encompass any computing device such as a programmable logic controller (PLC). Additionally, the computer system 500 can include a input device, such as a keypad, keyboard, touch screen, or other device that can accept user information, and an output device that conveys information associated with the operation of the computer system 500.

The computer system 500 includes a processor 505. Although illustrated as a single processor 505 in FIG. 5, two or more processors may be used according to particular needs, desires, or particular implementations of the computer system 500. Generally, the processor 505 executes instructions and manipulates data to perform the operations of the computer system 500 and any algorithms, methods, functions, processes, flows, and procedures as described in this specification.

The computer system 500 also includes a memory 507 that can hold data for the computer system 500 or other components (or a combination of both) that can be connected to the network. Although illustrated as a single memory 507 in FIG. 5, two or more memories 507 (of the same or combination of types) can be used according to particular needs, desires, or particular implementations of the computer system 500 and the described functionality. While memory 507 is illustrated as an integral component of the computer system 500, memory 507 can be external to the computer system 500. The memory 507 can be a transitory or non-transitory storage medium.

The memory 507 stores computer-readable instructions executable by the processor 505 that, when executed, cause the processor 505 to perform operations, such as determining whether the tubular 101 is stuck within the wellbore and transmitting a pressure signal to cause the hydraulic chamber 107 to pressurize one or more of the expandable pads 105, thereby causing the one or more expandable pads 105 to expand and exert a force necessary to free the tubular 101. For more examples of operations that can be performed by the processor 205, refer to the descriptions of methods 300 and 400 (FIGS. 3 and 4 and associated text). The computer system 500 can also include a power supply 514. The power supply 514 can include a rechargeable or non-rechargeable battery that can be configured to be either user- or non-user-replaceable. The power supply 514 can be hard-wired.

In this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

In this disclosure, "approximately" means a deviation or allowance of up to 10 percent (%) and any variation from a mentioned value is within the tolerance limits of any machinery used to manufacture the part. Likewise, "about" can also allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

While this disclosure contains many specific implementation details, these should not be construed as limitations on the subject matter or on what may be claimed, but rather as descriptions of features that may be specific to particular implementations. Certain features that are described in this disclosure in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Nevertheless, it will be understood that various modifications, substitutions, and alterations may be made. While operations are depicted in the drawings or claims in a particular order, this should not be understood as requiring that such operations be performed in the particular order shown or in sequential order, or that all illustrated operations be performed (some operations may be considered optional), to achieve desirable results. Accordingly, the previously described example implementations do not define or constrain this disclosure.

What is claimed is:

1. An apparatus comprising:

a tubular;

three pressure sensors distributed along an outer circumference of the tubular;

three expandable pads distributed along the outer circumference of the tubular;

a hydraulic chamber disposed within the tubular, the hydraulic chamber configured to expand each of the expandable pads independently; and a computer system disposed within the tubular, the computer system comprising:

a processor; and a storage medium interoperably coupled to the processor and storing programming instructions for execution by the processor, the programming instructions instructing the processor to perform operations comprising:

in response to determining that the tubular is stuck within the wellbore:

determining a locale of sticking of the tubular based on the pressure readings transmitted by the pressure sensors; and transmitting a pressure signal to cause the hydraulic chamber to pressurize one or more of the expandable pads that are closest to the locale of sticking of the tubular, thereby causing the one or more expandable pads to expand and exert a force necessary to free the tubular.

2. The apparatus of claim 1, wherein the programming instructions instruct the processor to perform operations comprising determining that the tubular is stuck within the wellbore based on the pressure readings transmitted by the pressure sensors.

3. The apparatus of claim 2, wherein the programming instructions instruct the processor to perform operations comprising:

determining the force necessary to free the tubular based on the pressure readings transmitted by the pressure sensors; and determining a corresponding pressure necessary in the hydraulic chamber to expand the one or more expandable pads and exert the force to free the tubular.

4. The apparatus of claim 1, comprising three circulating ports distributed along the outer circumference of the tubular, and wherein the programming instructions instruct the processor to perform operations comprising transmitting a circulation signal to cause one or more of the circulating ports to open and allow circulation of drilling fluid out of the tubular.

5. The apparatus of claim 4, wherein the expandable pads are positioned on the tubular between the circulating ports and the pressure sensors.

6. The apparatus of claim 1, wherein a distribution of the expandable pads along the outer circumference of the tubular is the same as a distribution of the pressure sensors along the outer circumference of the tubular.

7. A method comprising:

detecting pressure, by three pressure sensors, at three locations corresponding to a distribution of the three pressure sensors along an outer circumference of a tubular disposed within a wellbore; and by a computer system disposed within the tubular:

determining that the tubular is stuck within the wellbore based on the detected pressures;

in response to determining that the tubular is stuck within the wellbore:

determining a locale of sticking of the tubular based on the detected pressures;

determining a force necessary to free the tubular based on the detected pressures;

determining a pressure necessary in a hydraulic chamber to exert the force necessary to free the tubular; and transmitting a pressure signal to cause the hydraulic chamber to pressurize one or more expandable pads that are closest to the locale of sticking of the tubular, thereby causing the one or more expandable pads to expand and exert the force to free the tubular.

8. The method of claim 7, wherein the apparatus comprises three circulating ports distributed along the outer circumference of the tubular, and the method comprises transmitting, by the computer system, a circulation signal to cause one or more of the circulating ports to open and allow circulation of drilling fluid out of the tubular.

9. A method comprising:

receiving a plurality of pressure readings from a plurality of pressure sensors distributed along an outer circumference of a tubular disposed within a wellbore;

determining that the tubular is stuck within the wellbore based on the plurality of pressure readings; and in response to determining that the tubular is stuck within the wellbore:

determining a locale of sticking of the tubular based on the plurality of pressure readings; and transmitting a signal to cause one or more expandable pads that are closest to the locale of sticking of the tubular to expand and exert a force to free the tubular.

10. The method of claim 9, comprising determining a force necessary to free the tubular based on the plurality of pressure readings.

11. The method of claim 10, comprising determining a corresponding pressure necessary in a hydraulic chamber disposed within the tubular to exert the force to free the tubular.

12. The method of claim 11, wherein the signal causes the hydraulic chamber to pressurize the one or more expandable pads distributed along the outer circumference of the tubular that are closest to the locale of sticking of the tubular, thereby causing the one or more expandable pads to expand and exert the force to free the tubular.

13. The method of claim 12, comprising transmitting a circulation signal to one or more circulating ports distributed along the outer circumference of the tubular to cause the one or more circulating ports to open and allow circulation of drilling fluid out of the tubular.

14. The method of claim 13, wherein the circulation signal is transmitted after the signal that causes the force to be exerted to free the tubular.

* * * * *